US005513085A

United States Patent [19]

Bourne

[11] Patent Number: 5,513,085

[45] Date of Patent: Apr. 30, 1996

[54] RETRACTABLE LIGHT AND MOTION DETECTOR

[76] Inventor: Steven M. Bourne, 6800 298th Ave. North, Clearwater, Fla. 34621

[21] Appl. No.: 275,851

[22] Filed: Apr. 13, 1994

Related U.S. Application Data

[63] Continuation-in-part of Ser. No. 10,139, Jan. 28, 1993, abandoned.

[51] Int. Cl.[6] ..... F21V 21/22

[52] U.S. Cl. ..... 362/286; 362/274; 362/289; 362/386

[58] Field of Search ..... 362/153, 269, 362/274, 285, 286, 289, 386, 418, 427, 428

[56] References Cited

U.S. PATENT DOCUMENTS

| | | | |
|---|---|---|---|
| 4,984,139 | 1/1991 | Goggia | 362/386 |
| 5,003,441 | 3/1991 | Crowe et al. | 362/285 |
| 5,068,773 | 11/1991 | Toth | 362/286 |
| 5,075,834 | 12/1991 | Puglisi | 362/386 |

*Primary Examiner*—I. Lazarus
*Assistant Examiner*—Y. Quach
*Attorney, Agent, or Firm*—Joseph C. Mason, Jr.; Ronald E. Smith

[57] ABSTRACT

An in-ground light, motion detector, or other active element is housed in a telescopically mounted housing so that it can be retracted to ground level when not in use and positioned above the ground when in use. A motor that extends and retracts the telescopically mounted housing relative to a main housing is rotatably mounted in a nonrotatable motor housing that adjoins the main housing. A plate having electrical contacts is mounted to the motor so that the contacts rotate when the motor rotates. A second plate having electrical contacts is nonrotatably secured to the motor housing so that relative rotation of the two plates activates and deactivates the motor. Relative rotation of the plates occurs when the telescopically mounted housing is fully extended or fully retracted because the rotational energy of the motor's output shaft is transferred to the motor when full extension or retraction has been achieved. In an alternative embodiment, a magnetic strip and associated sensor are employed to precisely control the instantaneous positioning of the telescoping housing with respect to the main housing. In another embodiment, the light pivots upon deployment into any preselected angular position, and a flexible boot protects the interior elements of the device when the telescopic housing is extended. Another embodiment has structure that prevents damage to the apparatus when the telescopically mounted housing is prevented from deploying or forced into its retracted position.

3 Claims, 12 Drawing Sheets

RETRACTABLE LIGHT AND MOTION DETECTOR

This is a continuation-in-part of application(s) Ser. No. 08/010,139 filed on Jan. 28, 1993, abandoned.

BACKGROUND OF THE INVENTION

1. Field of the Invention

This invention relates, generally, to active element-containing devices Chat are disposed below ground level when not in use and that are positioned above ground when in use.

2. Description of the Prior Art

U.S. Pat. No. 4,974,134 to the present inventor shows a light-containing housing telescopically received within a main housing that is disposed in a vertical bore formed in the ground. A slidably mounted motor positioned in a motor housing drives the light housing out of the main body when lighting is desired and retracts the light housing into the main body when it is not. The top of the light housing is substantially flush with the ground when said light housing is fully retracted.

In that early design, the motor is switched on and off by switches that are longitudinally spaced from one another in the motor housing, i.e., a first limit switch is disposed near the upper end of the motor housing and a second limit switch is positioned near the lower end of said housing. The output shaft of the motor rotates in a first direction to drive the light housing upwardly; as long as the light housing is traveling upwardly, the position of the motor is fixed. However, when the light housing is fully deployed, continued operation of the motor drives the motor downwardly, towards the bottom of the motor housing. A contact on the motor then connects with a contact on the upper limit switch, and the motor is deactivated. Conversely, when the output shaft of the motor is rotating in an opposite direction to retract the light housing, the motor is centered in the motor housing until the light housing is fully retracted. Continued operation of the motor then pulls the motor towards the top of the motor housing, until a contact on the motor abuts a contact on the lower limit switch that deactivates the motor.

Thus, the motor travels in a longitudinal direction within the motor housing; this requires that the housing be elongate. Moreover, the bearing that seals the output shaft of the motor must not only handle the rotational aspect of said output shaft, but it must also handle the longitudinal displacement aspect as well, i.e., the bearing must seal in different ways.

What is needed, then, is a design that makes less demand on the seal so that a less expensive seal could be used. Moreover, a design that would shorten the length of the motor housing would be desirable because less materials would then be required to fabricate the housing and the bore in the earth would not need to be quite as deep. Moreover, a simpler way to achieve motor activation and deactivation, and reversal of output shaft rotational direction, would make the apparatus less expensive to manufacture and perhaps more reliable as well. However, at the time the present invention was made, neither the just-described earlier device nor other known devices in the field of this invention taught or suggested to those of ordinary skill in this art how such art could be advanced in a significant way.

SUMMARY OF THE INVENTION

A bidirectional motor is rotatably mounted in a truncate, nonrotatable housing that does not permit longitudinal travel of the motor therein. A pair of unique plate members, one of which is rotatable conjointly with the motor, are positioned in the same housing in abutting, facing relation to one another. Electrical contacts are formed on the lower surface of the upper plate and on the upper surface of the lower plate. The lower plate is fixedly secured to the motor so that it rotates conjointly with the motor, and the upper plate is secured to the nonrotatable housing so that it does not rotate.

Preselected contacts on the upper and lower plates contact one another when the output shaft of the motor is rotating in a first direction to drive an active element-containing housing upwardly. When the housing is fully extended above the ground level, continued output of rotational energy to the output shaft causes rotation of the motor because the output shaft can no longer rotate after the housing has been fully extended. Rotation of the motor and of the plate fixedly secured to it brings a different set of contacts into contact with one another, and the motor is deactivated. Subsequent reactivation of the motor results in the output shaft rotating in the opposite direction and concomitant retraction of the housing into its below-ground position. Again, when the housing is fully retracted, continued output of rotational energy to the output shaft results in rotation of the motor since the output shaft can no longer rotate after the housing is fully retracted. The rotation of the motor and its plate realigns the contacts between the rotating plate and the non-rotating plate, and the motor is again deactivated.

The active element in the telescopically mounted housing may be a light of any kind, a motion detector of the infrared or other type, a combination of a light and a motion detector, or any other active element or combination of elements desired by the owner of the novel apparatus.

Thus it is seen that the primary object of this invention is to advance the art of retractable active elements by providing a more compact housing for the motor that extends and retracts the active element or elements.

Another important object is to enable use of a simpler seal by eliminating longitudinal travel of the motor's output shaft.

Still another important object is to provide a highly reliable construction so that the apparatus will provide many years of trouble-free operation.

Yet another important object is to reduce the costs of manufacturing retractable devices of the type heretofore known.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
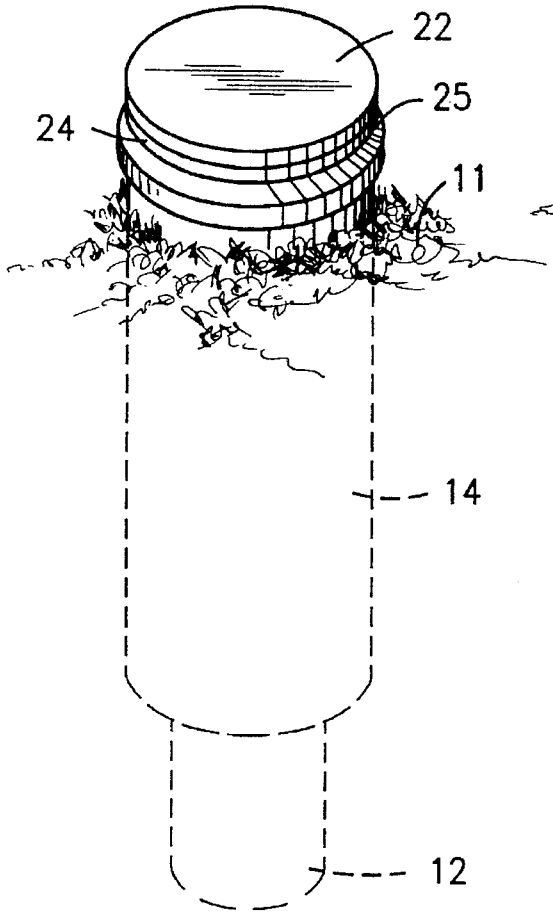
FIG. 1 is a perspective view of the novel device when fully retracted into substantially flush relation with a ground surface.
Figure 2:
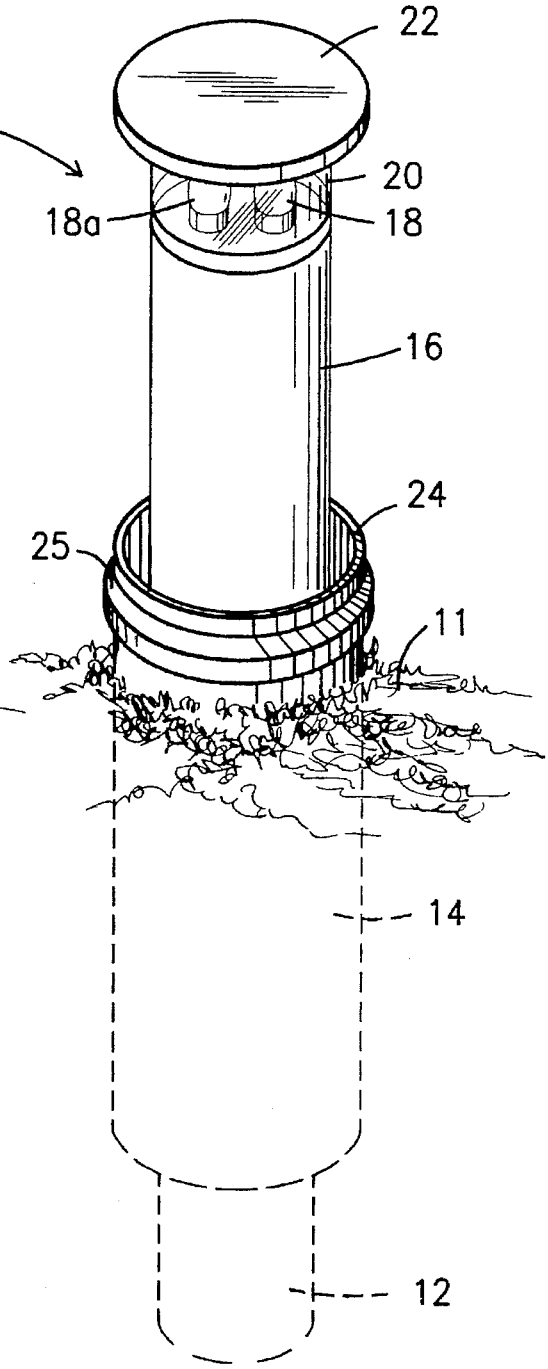
FIG. 2 is a perspective view of the device when fully extended.

Referring now to FIG. 1, reference numeral 10 indicates an exemplary embodiment of the invention as a whole, and 11 denotes the ground. As best shown in FIG. 2, apparatus 10 includes a nonrotatable motor drive housing 12, a nonrotatable main housing 14, and a nonrotatable active element-containing housing 16 that is telescopically mounted in main housing 14. All of said housings are in axial alignment with one another. A light, motion detector, or other active element, or any combination thereof, are indicated by reference numerals 18, 18*a*. Active elements 18, 18*a* surmount light housing 16 and are encased by a clear shield 20 of predetermined geommetrical configuration that protects them from rain, snow, insects, and the like. One or more reflectors may also be provided to reflect light where one of the active elements is a light. Top plate 22 closes the uppermost end of cylindrical shield 20, and rests atop the uppermost rim 24 of main housing 14 when housing 16 is fully retracted, as shown in FIG. 1.

Figure 3:
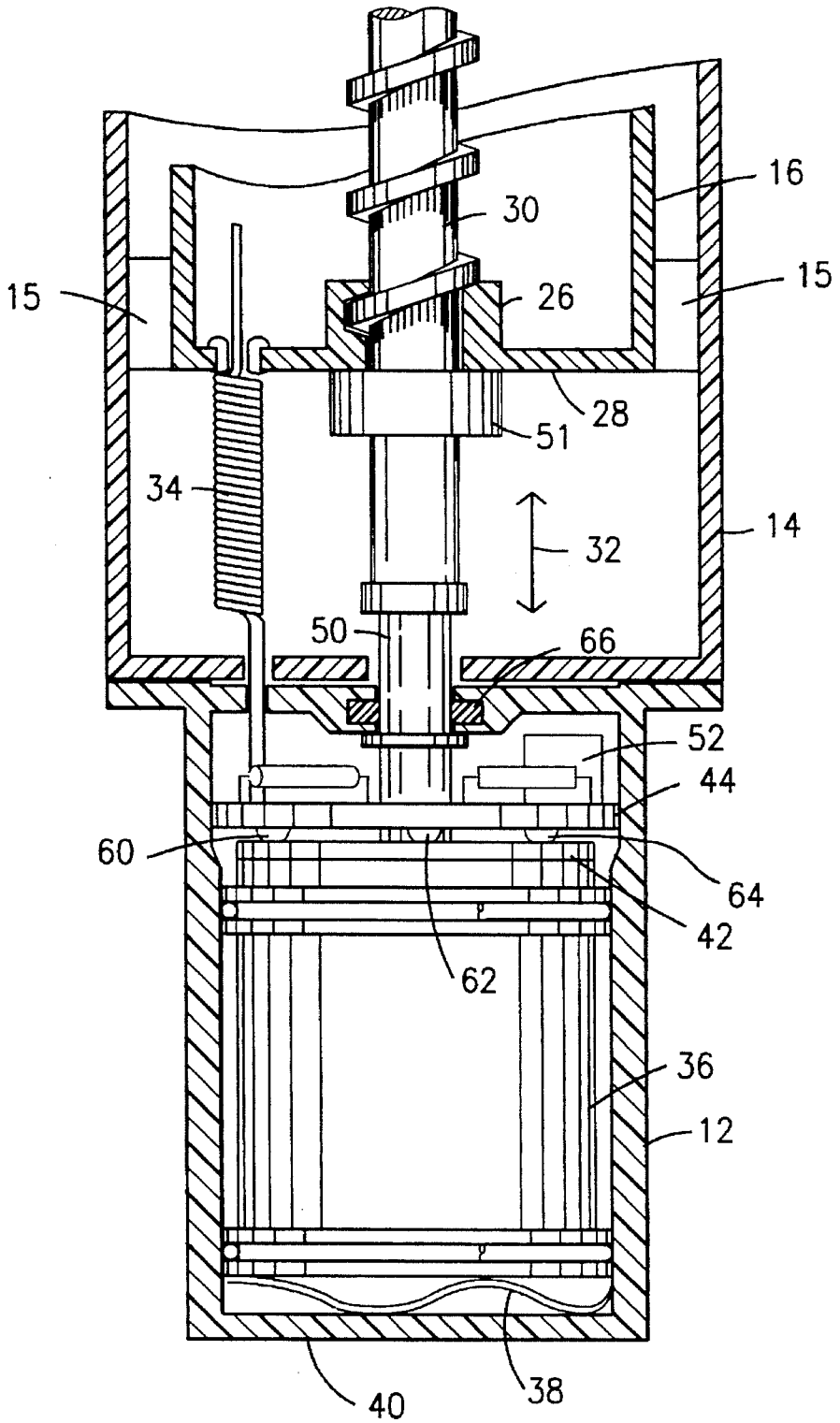
FIG. 3 is a longitudinal sectional view of the device with the active element-containing housing in its retracted position.

FIG. 3 also shows motor housing 12, main housing 14, and telescopically mounted housing 16. As in the present inventor's earlier design, housing 16 has a boss 26 formed in its bottom wall 28 that engages worm gear 30 so that rotation of worm gear 30 in a first direction drives housing 16 in a first direction, and rotation of said worm gear in a second direction drives said housing in a second direction, as indicated by double-headed directional arrow 32. Collar 51, integral with shaft 50, is employed to stop downward travel of housing 16. When downward travel of housing 16 is stopped by collar 51, or when upward travel of housing 16 is stopped by wings 15 abutting stops 23 (see FIG. 10), the rotational energy of gear 30 is transferred to motor 36 so that said motor rotates. The motor does not rotate when housing 16 is going up or down, i.e., it rotates only after housing 16 has reached its fully extended or fully retracted positions. The worm gear and motor output shaft 50 are in axial alignment with one another and suitable means are employed to join worm gear 30 to said output shaft so that it rotates conjointly therewith. Note that collar 51 could be positioned lower on shaft 50 to shorten the overall length of the device when housing 16 is fully retracted.

Electrical cord 34 performs the same function in this improved apparatus as in the earlier-disclosed inventive apparatus, i.e., it is coiled so that it extends and retracts as needed as housing 16 travels upwardly and downwardly, respectively.

Figure 4:
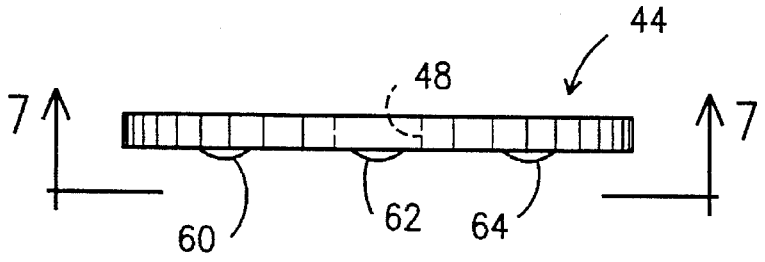
FIG. 4 is a side elevational view of the nonrotatably mounted plate.
Figure 5:
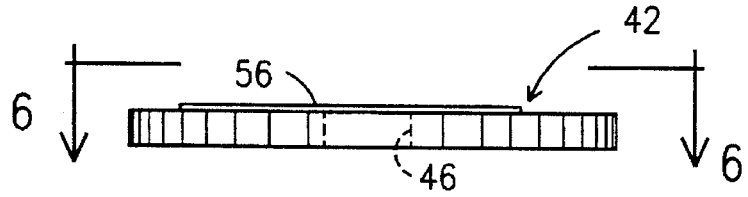
FIG. 5 is a side elevational view of the plate that is fixedly secured to the motor and transmission housing.
Figure 6:
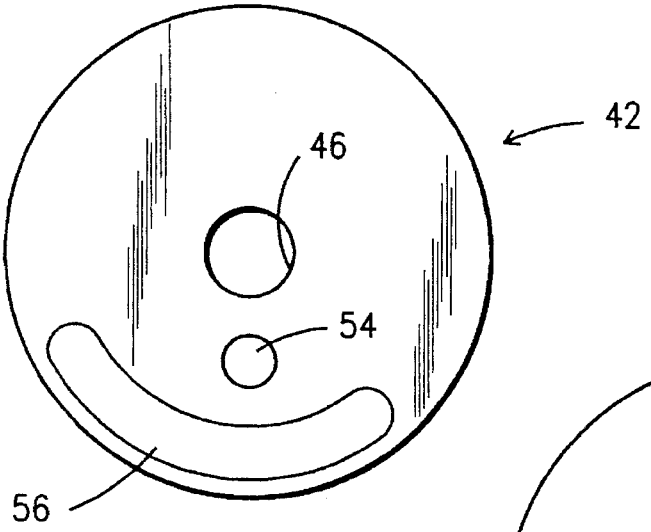
FIG. 6 is a plan view taken along line 6—6 in FIG. 5.
Figure 7:
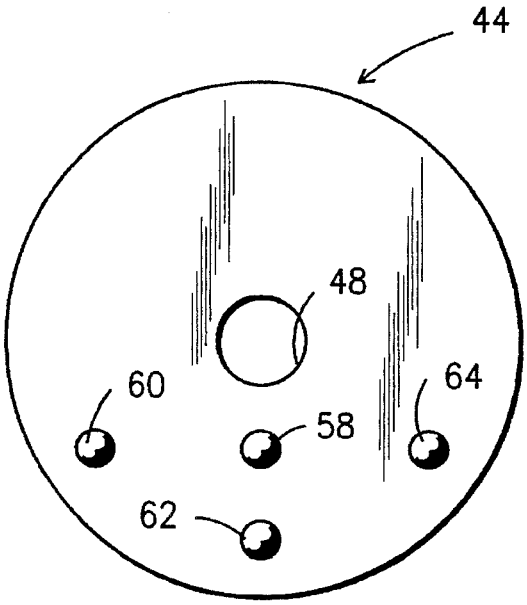
FIG. 7 is a plan view of the nonrotatably mounted plate, taken along line 7—7 in FIG. 4.

Motor 36 is biased upwardly, i.e., toward the ground surface, by a bias means 38 that is supported by bottom wall 40 of motor housing 12. Circular lower plate 42 surmounts motor and transmission housing 36 and is fixedly secured thereto for conjoint rotation therewith as aforesaid by any suitable means, and nonrotatable circular upper plate 44 surmounts plate 42. Note that the nonrotatable plate 44 is fixedly secured at its outermost periphery to the inner side walls of nonrotatable motor housing 12. Both plates are centrally apertured as at 46, 48, respectively (FIGS. 4 and 5), to receive output shaft 50. The electronic circuitry that controls operation of device 10 is mounted atop upper plate 44 and is denoted 52, generally, in FIG. 3. Upper plate 44 includes electrical contacts 58, 60, 62, and 64 as best depicted in FIG. 7. Lower plate 42 includes electrical contacts 54 and 56, the latter being arcuate as depicted in FIG. 6.

Figure 8:
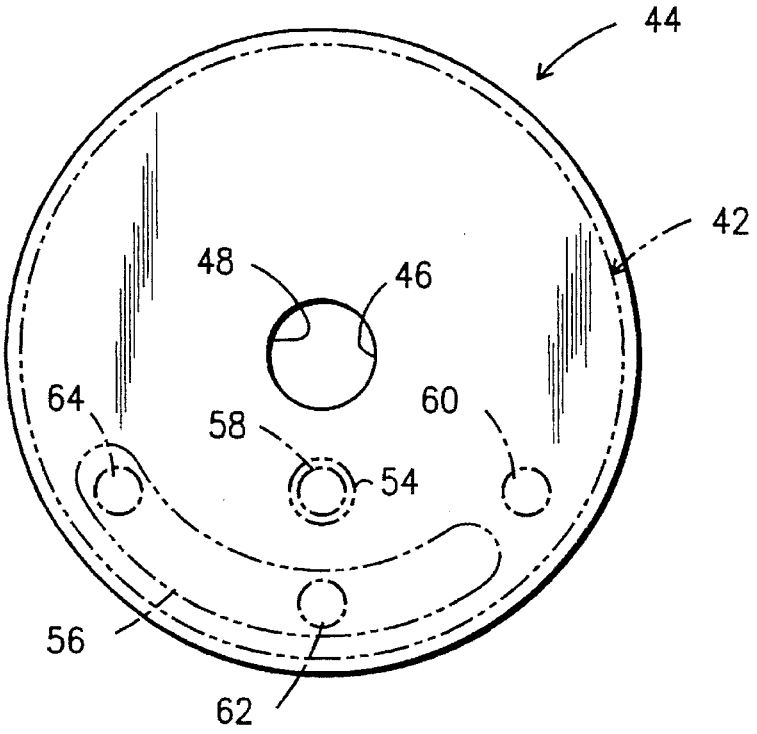
FIG. 8 is a plan view showing a first rotational position of the plate of FIG. 6 relative to the plate of FIG. 7.
Figure 9:
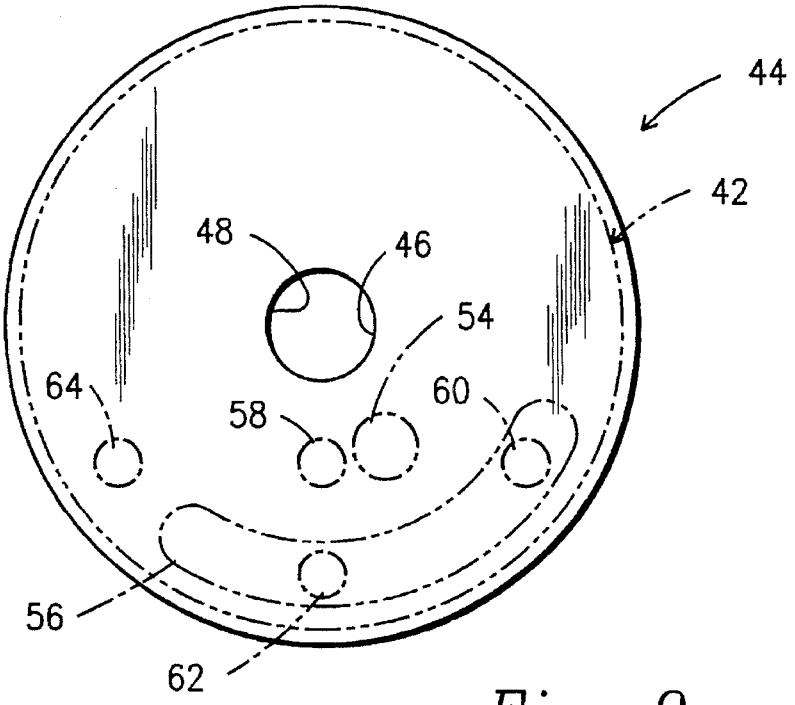
FIG. 9 is a plan view showing a second rotational position of the plate of FIG. 6 relative to the plate of FIG. 7.

FIG. 8 shows the alignment of electrical contacts when housing 16 is fully extended relative to main housing 14, and FIG. 9 shows the alignment when said housing 16 is fully retracted relative to said main housing. Contacts 56, 60, 62, and 64 are a part of the motor circuit whereas contacts 54, 58 are a part of the lighting circuit. Note in FIG. 8 that when contacts 56, 64, and 62 are in electrical communication with one another, light contacts 54, 58 are also in electrical communication with one another. Thus, housing 16 is extended and the light is on. In FIG. 9, contact 64 is no longer in contact with arcuate contact 56, and contacts 54, 58 are misaligned. Thus, housing 16 is retracted and the light is off. Additional contacts similar to contacts 54, 58 could be provided for motion detectors or other devices.

A comparison of FIGS. 8 and 9 reveals how the novel switch changes from the FIG. 8 position to the FIG. 9 position and vice versa. The rotation is powered by the torque of motor 36. More particularly, it will be observed in FIG. 9 that arcuate contact 56 is in electrical communication with contacts 62 and 60 when housing 16 is fully retracted as aforesaid. Upon activation of a switch, the output shaft of the motor begins rotating in a first direction and such rotation continues even after housing 16 is fully extended. However, full extension of the main housing results in rotation of the motor and transmission housing 36 in a second direction opposite to said first direction so that arcuate contact 56 is displaced from the FIG. 9 position to the FIG. 8 position. That displacement disconnects contact 60, and therefore the motor is shut off. However, contact 54 rotates into electrical communication with contact 58 and therefore the light is activated. When the light is to be retracted, the output shaft of the motor rotates in a direction opposite to the first direction until the housing 16 is fully retracted. Continued rotation of the output shaft brings the bottom wall 28 of housing 16 into abutting relation to collar 51, thereby stopping further downward travel of housing 16 and thereby causing the motor to rotate in said second direction, i.e., the motor moves from the FIG. 8 position to the FIG. 9 position, thereby disconnecting contact 64 and again shutting down the motor. The light is also deactivated as contact 54 separates from contact 58.

It should be appreciated that the torque of the motor can be harnessed to effect retraction and extension in other ways as well. For example, plates 42 and 44 could be eliminated and a radially extending arm could be secured to the motor. Rotation of the motor in a first direction would bring such arm into throwing contact with a switch that would cause extension of the telescoping housing and activation of the lamp and rotation of the motor in a second direction would cause retraction of the telescoping housing and deactivation of the lamp.

Seal 66 (FIG. 3) is required only to seal rotational movement of output shaft 50, there being no longitudinal displacement of said shaft. Since neither the output shaft nor the motor travel longitudinally, the longitudinal extent of housing 12 is reduced to a minimum, thereby minimizing the longitudinal extent of the entire assembly 10, simplifying the construction of apparatus 10, and increasing its reliability.

Figure 11:
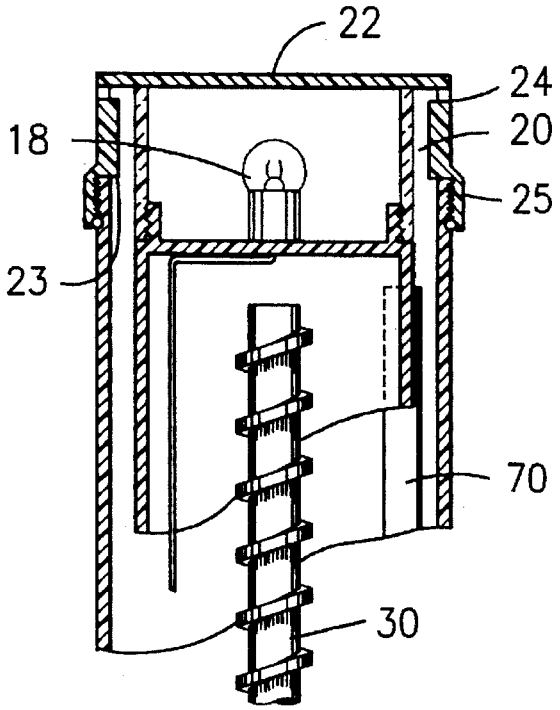
FIG. 11 is a sectional view taken along line 11—11 in FIG. 10.
Figure 11:
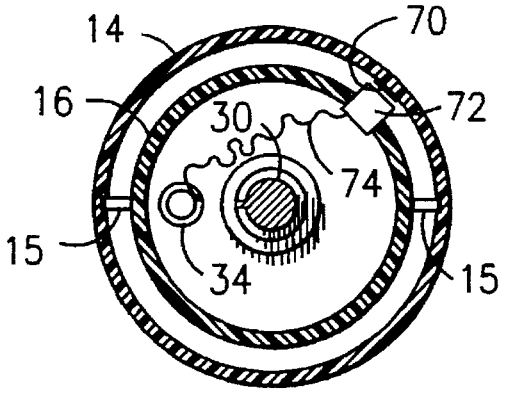
Figure 10:
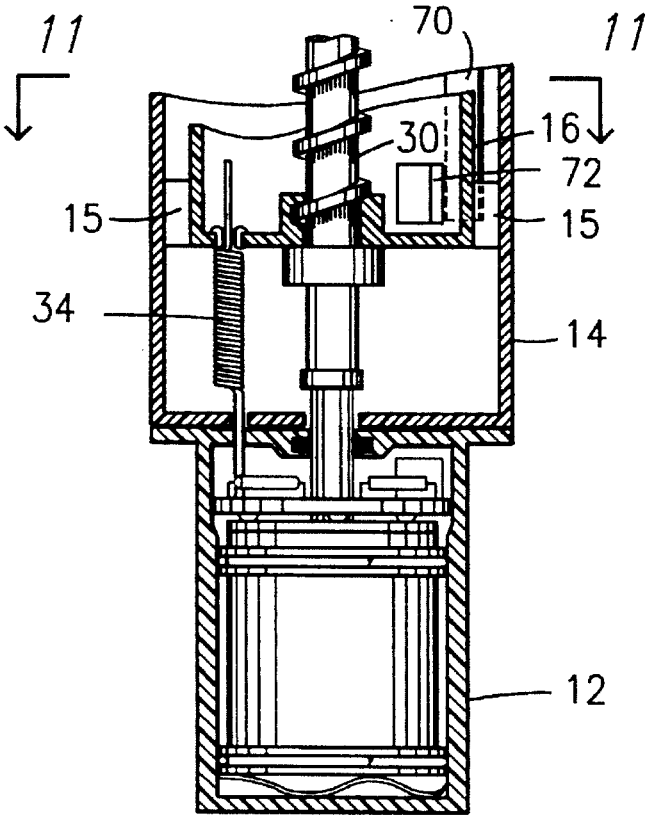
FIG. 10 is a broken, partially sectional view of a second embodiment of the invention.

A means for precisely controlling the amount of vertical extension of telescoping housing 16 is shown in FIGS. 10 and 11. A flat strip 70 of magnetic material is secured by suitable means to an inner flat cylindrical sidewall of main housing 14, and position information is stored along the extent of said strip. A sensor means or reading head 72 is fixedly secured within telescoping housing 16 at the top or bottom end of said strip 70, as shown in FIG. 10.

Thus, as telescoping housing 16 travels with respect to stationary housing 14, sensor means 72 is displaced along the extent of magnetic strip 70. Position information may be passively supplied to sensor 72 and reported to a monitoring means, not shown, to display information that reports the instantaneous position of telescoping housing 16 with respect to main housing 14. Alternatively, sensor means 72 may take an active role and be used to control the instantaneous vertical position of telescoping housing 16. In either mode, electrical signals are delivered to sensor 72 by line 74 which has a length sufficient to reach said sensor 72 when housing 16 is fully extended.

It should be observed that the respective positions of strip 70 and sensor means 72 could be reversed, i.e., strip 70 could be secured to telescoping housing 16 and sensor means 72 could be secured to main housing 14.

As mentioned briefly above, FIG. 10 also discloses a pair of diametrically opposed, radially inwardly extending stops 23 formed in cap 25 (also depicted in FIGS. 1 and 2) that screw threadedly engages the uppermost end of housing 14. A pair of diametrically opposed, radially outwardly extending wings 15 secured to the trailing end of telescoping housing 16 abut said stops 23 when housing 16 is fully extended to prevent it from escaping housing 14.

An embodiment that deploys a lamp into any preselected angular orientation is depicted in FIGS. 12–22. A lamp 80 is mounted within a lamp housing 81 that is supported by a pair of laterally spaced apart frames 82, only one of which is shown in the FIGS. More particularly, frames 82 rotatably support a pair of axle members 84, only one of which may be seen. A torsion spring 86 having legs 87, 88 has a circular part that receives an axle 84 as shown; leg 88 engages a frame 82 and is held against movement thereby. Leg 87 is similarly connected by suitable means to lamp housing 81 (by having a bent part that extends thereinto through an opening formed in said housing, e.g.) and thus urges housing 81 to rotate in a clockwise direction because the bias of spring 86 urges legs 87, 88 to diverge from one another.

Figure 13:
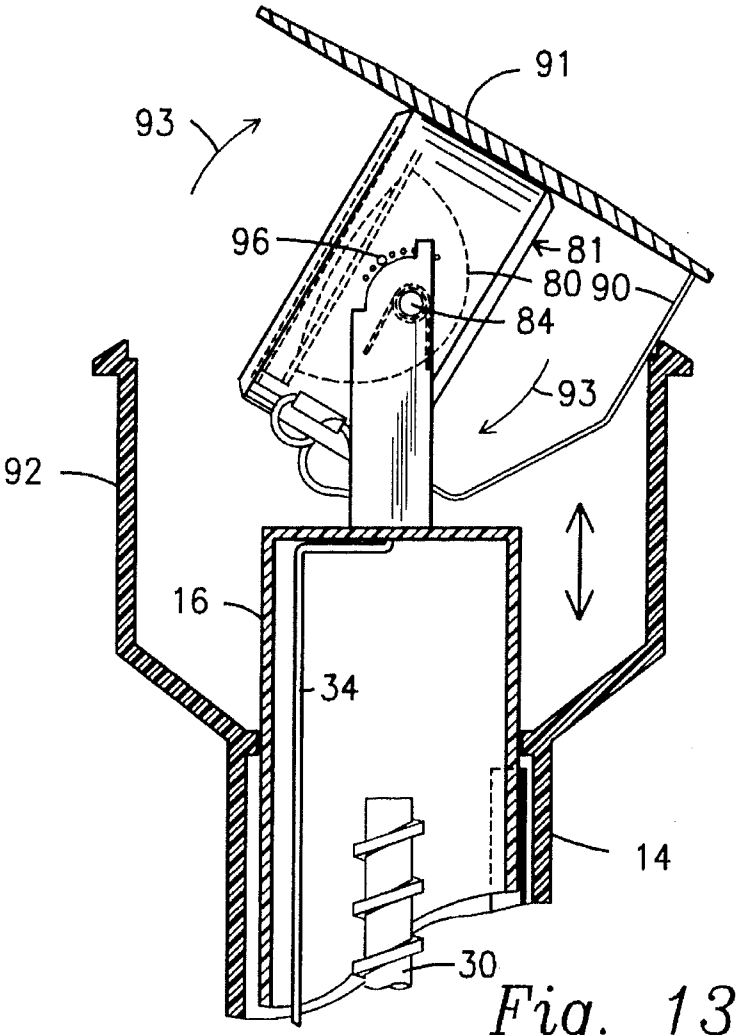
FIG. 13 is a side elevational, sectional view depicting the lamp of FIG. 12 in a partially deployed configuration.
Figure 12:
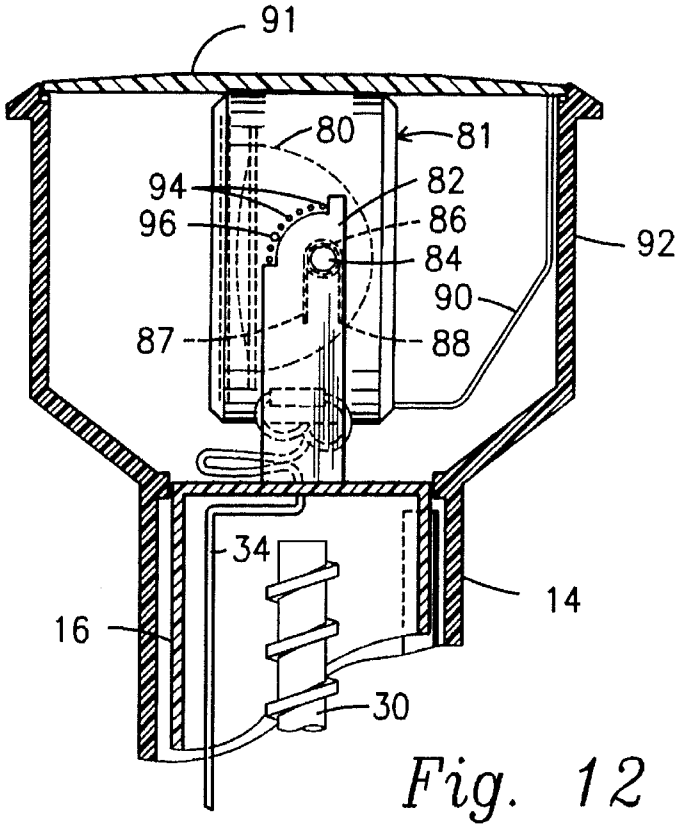
FIG. 12 is a side elevational, sectional view of an alternative embodiment having a pivotally mounted lamp, showing the lamp in its fully retracted configuration.

A stiff wire or retainer means 90, or other suitable material, extends from the trailing lower edge of housing 81 to a peripheral edge of closure means or cap 91, and said cap 91 closes enclosure 92 when the lamp is fully retracted as depicted in FIG. 12. Enclosure 92 bars movement of wire or rod 90 as long as housing 81 is fully retracted. However, as depicted in FIG. 13, as housing 81 is extended, the bias of torsion spring 86 rotates frame 81 in a clockwise direction as indicated by directional arrows 93.

Returning now to FIG. 12, it will there be seen that a plurality of openings, collectively denoted 94, are formed in housing 81 in an arcuate array. By placing a pin such as pin 96 (FIG. 12) in a preselected hole, the user may control the amount of clockwise rotation of housing 81; note in FIG. 14 how pin 96 determines the final configuration of housing 81 and hence of lamp 80.

Figure 16:
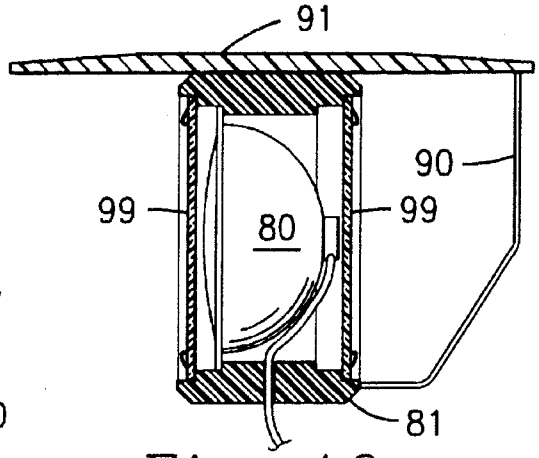
FIG. 16 is a side elevational, sectional view of the lamp frame which facilitates mounting of the lamp in either of two positions where the light from the lamp may be directed in an opposite direction upon reversal of the lamp.
Figure 17:
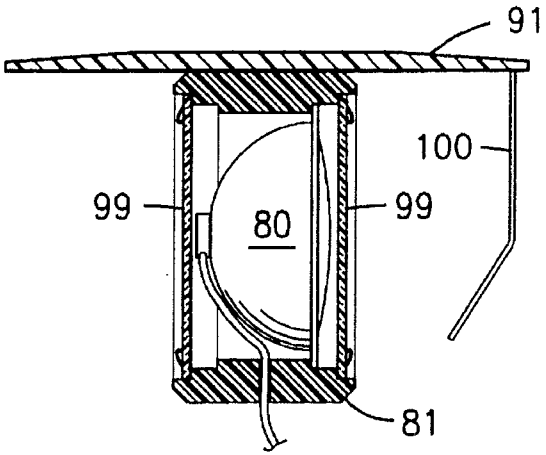
FIG. 17 is a side elevational, sectional view of an alternate embodiment of the means for preventing rotation of the lamp upon deployment.
Figure 15:
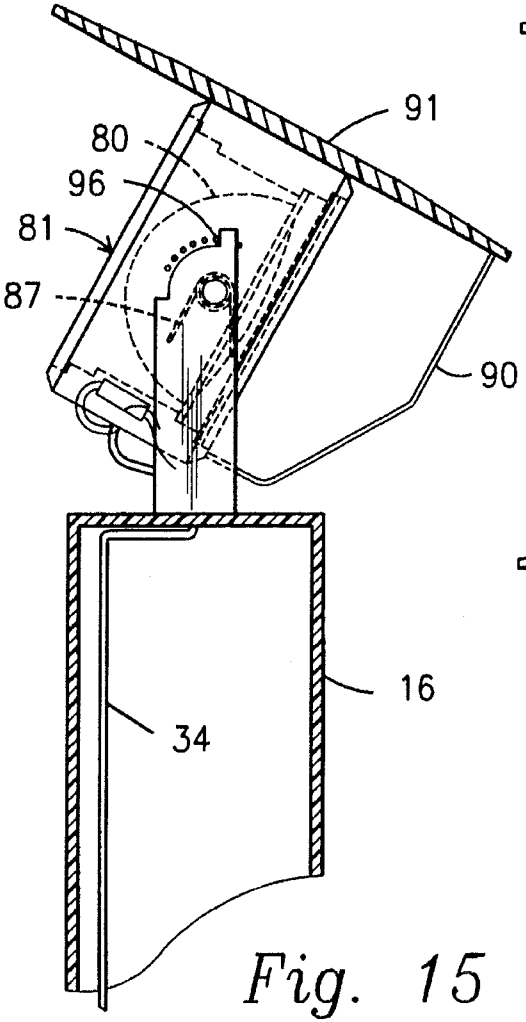
FIG. 15 is a side elevational, sectional view of the lamp of FIG. 12 when fully deployed in an alternate configuration and when the position of the lamp within its housing has been reversed.
Figure 14:
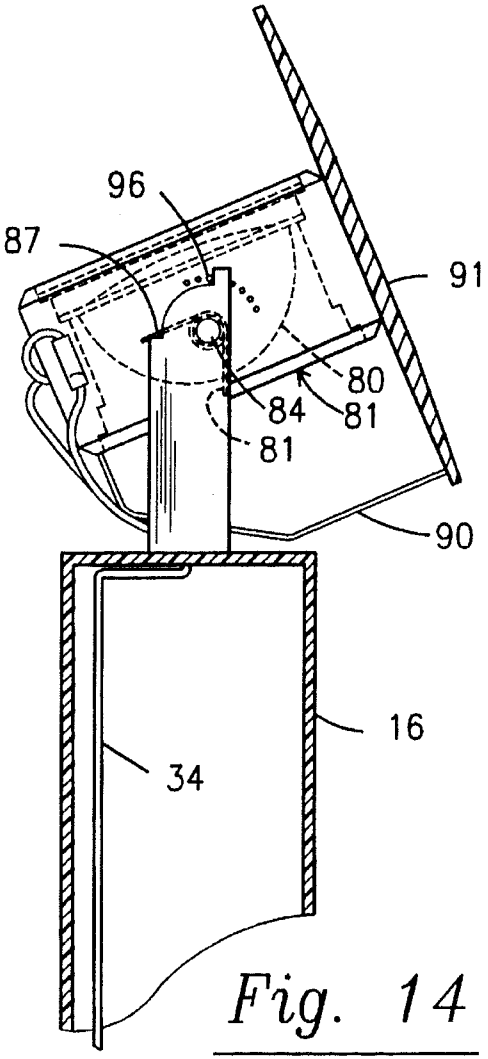
FIG. 14 is a sectional view depicting the lamp of FIG. 12 in a fully deployed configuration.

As perhaps best understood in connection with FIGS. 16 and 17, the position of lamp 80 within housing 81 is easily reversed. Thus, where a pin 96 is inserted into an aperture 94 as depicted in FIG. 15, thereby providing the angular orientation of housing 81 as depicted in said FIG. 15, reversing the position of lamp 80 directs the lightwaves therefrom in a downward direction; such a configuration is suitable for walkway lighting, whereas such configuration would be more suitable for landscape lighting if the lamp position were not reversed.

FIGS. 16 and 17 also depict a front and back lens cover 99 which has utility in protecting lamp 80 from rain or water from ground sprinklers.

FIG. 17 indicates that wire rod 100 need not extend to frame 81 as long as it is sufficiently stiff.

Figure 20:
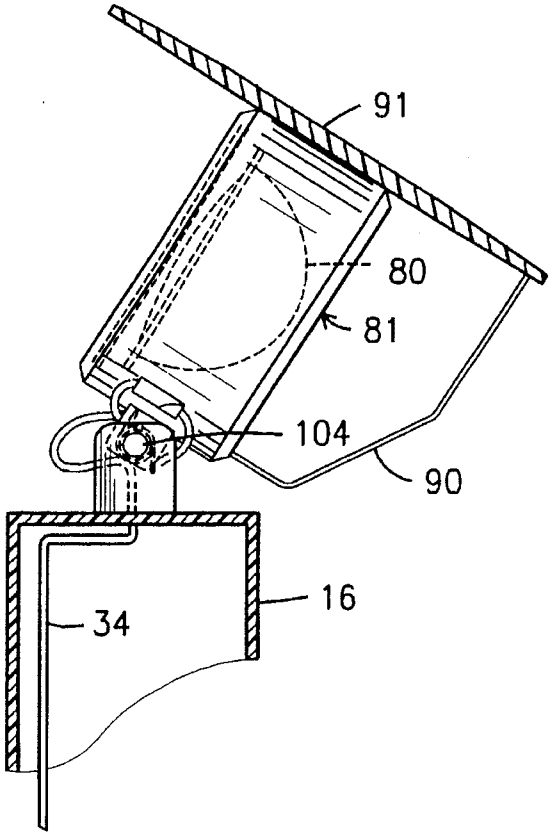
FIG. 20 is a view like that of FIG. 18, but showing the lamp in a deployed configuration.
Figure 19:
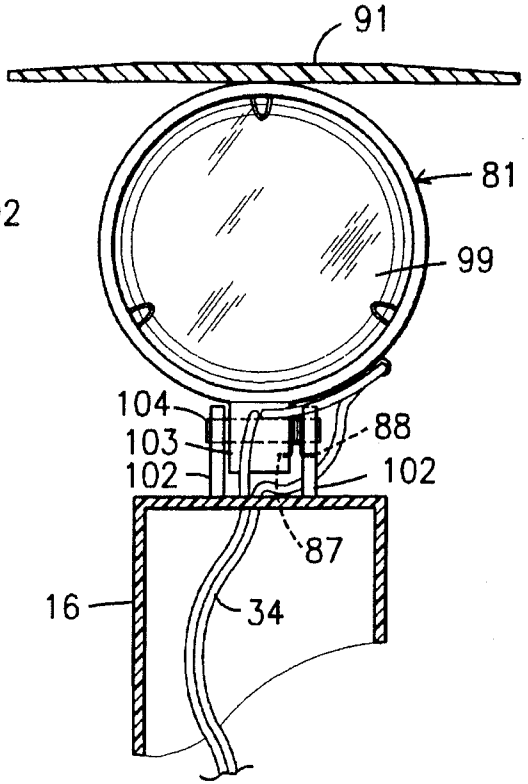
FIG. 19 is a front elevational, partially sectional view of the parts shown in FIG. 18 but in an extended position.
Figure 18:
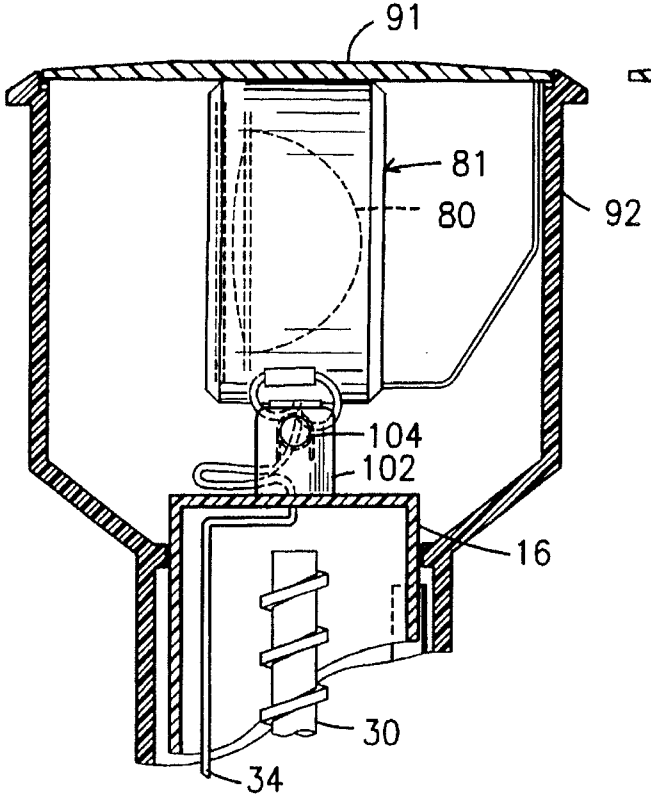
FIG. 18 is a side elevational, partially sectional view of an alternate means for pivotally mounting the lamp housing, said lamp housing being in its fully retracted configuration.

An alternate mount for torsion spring 86 is depicted in FIGS. 18–20. This embodiment eliminates frames 82 of the preceding embodiment, and in lieu thereof includes a pair of laterally spaced apart ears and axle member 104. Leg 87 engages a flange 103 that depends from lamp housing 81, and leg 88 engages an ear 102; accordingly, spring 86 urges rotation of housing 81 as in the preceding embodiment. Although not shown, a plurality of apertures could be formed in flange 103 and a pin means could be used to limit the amount of rotation, just as in the preceding embodiment.

Figure 21:
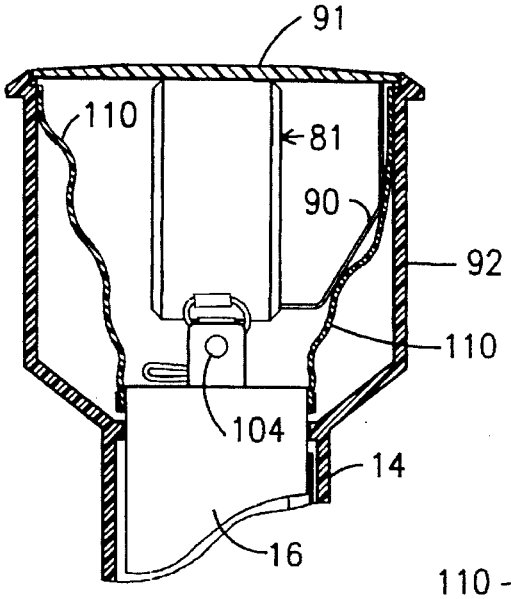
FIG. 21 is a side elevational, sectional view of a novel boot when the lamp is in its fully retracted position.
Figure 22:
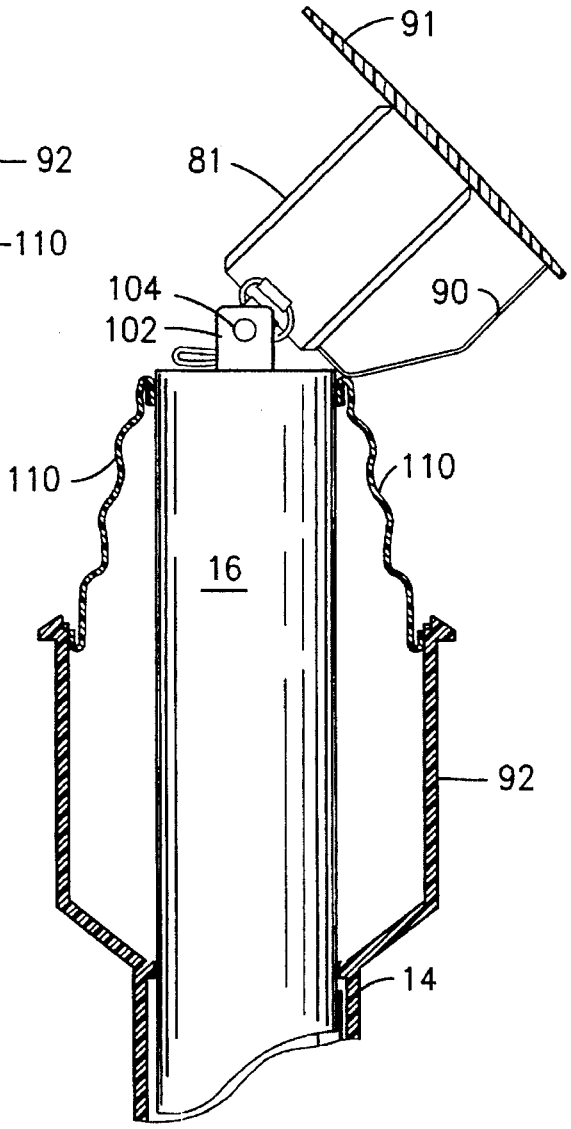
FIG. 22 is a view like that of FIG. 21 when the lamp is in a deployed configuration.

FIGS. 21 and 22 depict a flexible boot 110 that may be used with other embodiments disclosed herein. It is affixed to the perimeter of telescoping housing 16 at its first end and to the perimeter of enclosure 92 at its second end. More particularly, the first end of boot 110 is secured to an upper end of said telescoping housing in circumscribing relation thereto and its second end is secured to a perimeter of said closure means in circumscribing relation thereto. Thus, it prevents moisture, snow, leaves, debris, and the like from entering into enclosure 92 and the parts of the inventive structure therebelow.

Figure 23:
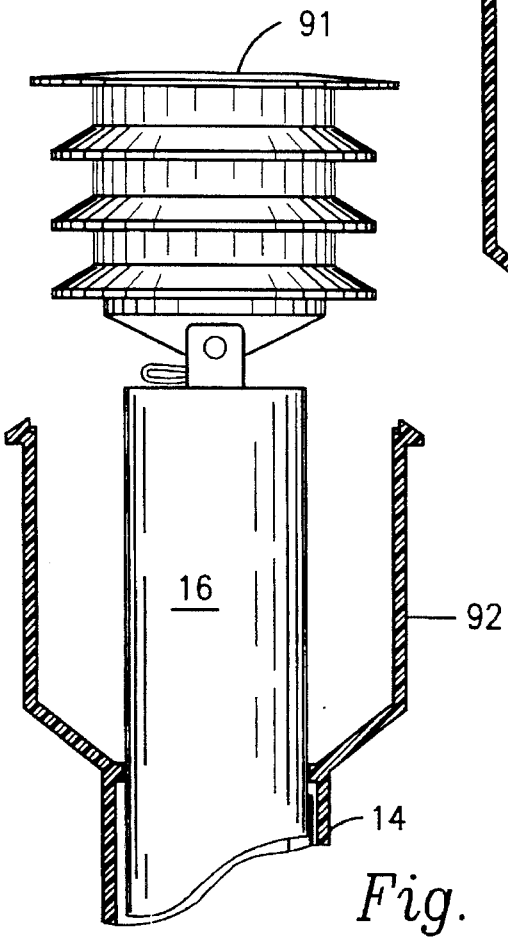
FIG. 23 is a side elevational view of an embodiment having a pagoda style.

FIG. 23 illustrates a non-pivoting embodiment having a pagoda-like appearance.

Figure 24:
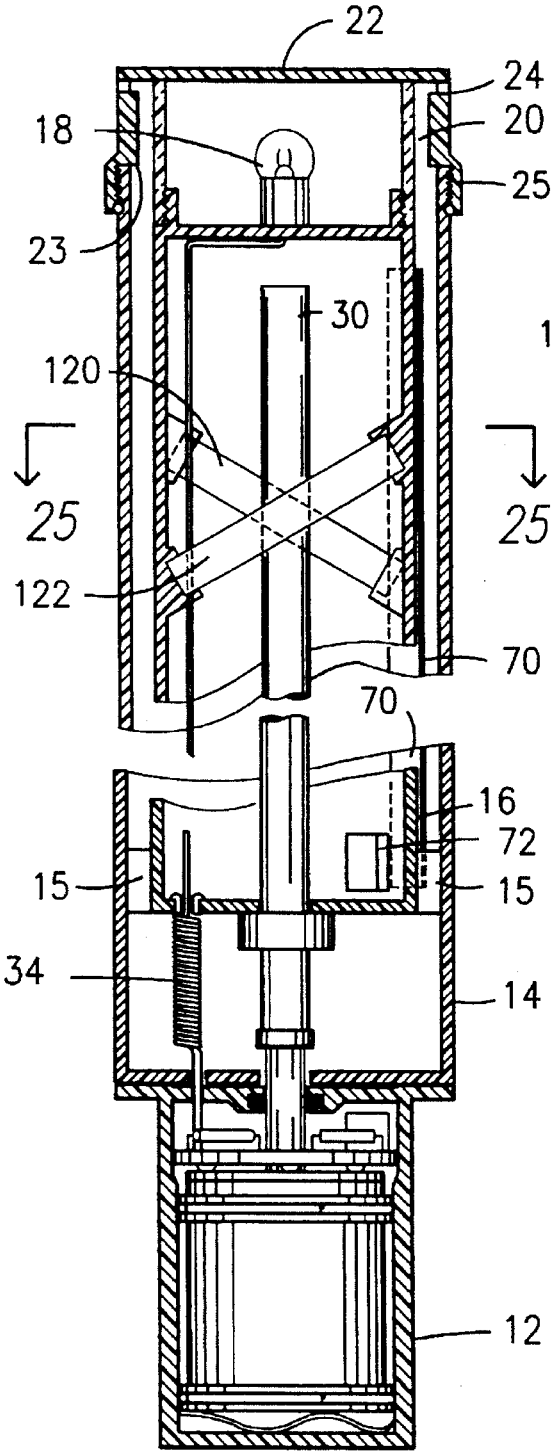
FIG. 24 is a side elevational, sectional view of an embodiment having a drive mechanism that includes a pair of angularly mounted gear members.
Figure 25:
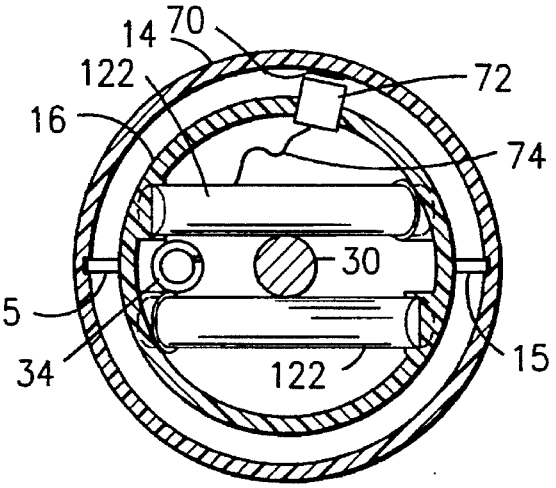
FIG. 25 is a sectional view taken along line 25—25 in FIG. 24.

The embodiment of FIGS. 24 and 25 includes a pair of nonrotatable screw members 120 and 122 having their opposite ends fixedly secured to telescoping housing 16 as shown, i.e., they form an "X" shape when viewed in side elevation. As depicted in FIG. 25, they are parallel to one another and screw threadedly engage opposite sides of worm gear 30. As worm gear 30 rotates about its axis of rotation, telescoping housing 16 travels up or down depending upon the direction of said rotation. If a car, lawnmower, person, or other heavy object is positioned atop closure 22 (or 91) when telescoping housing 16 is being driven in an upward direction, worm gear 30 will slip with respect to screw members 120, 122 and telescoping housing will not deploy. Significantly, no damage will thereby be inflicted upon the mechanism. Similarly, if housing 16 is already deployed, and a heavy object is placed atop it, it will retract under the influence of said weight and such retraction will not damage the mechanism.

Those knowledgeable in the mechanical arts will recognize the mechanism of FIGS. 24 and 25, because it is believed to have been used in some garage door openers and in other mechanical environments. It has not heretofore been used in the environment of retractable outdoor lighting.

Figure 28:
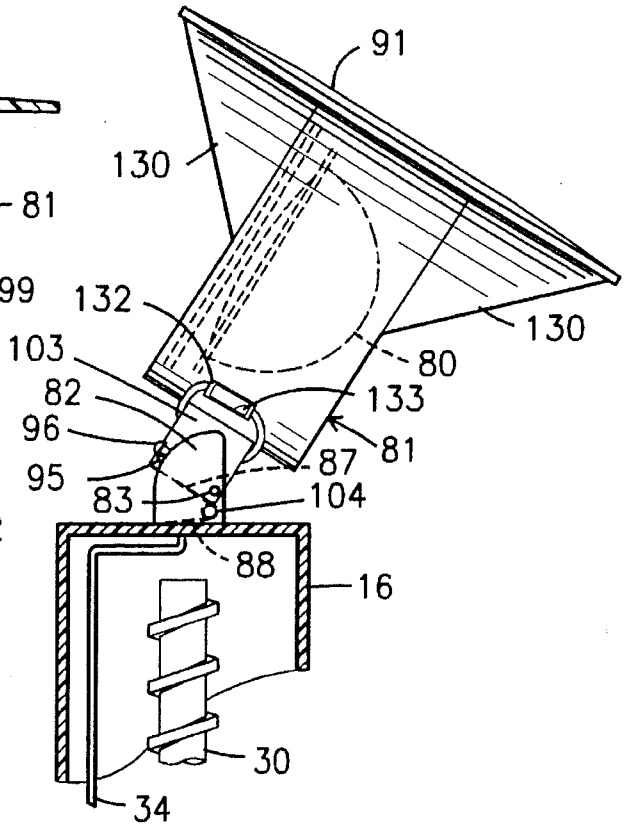
FIG. 28 is a side elevational view of the FIG. 26 embodiment when in its extended configuration.
Figure 27:
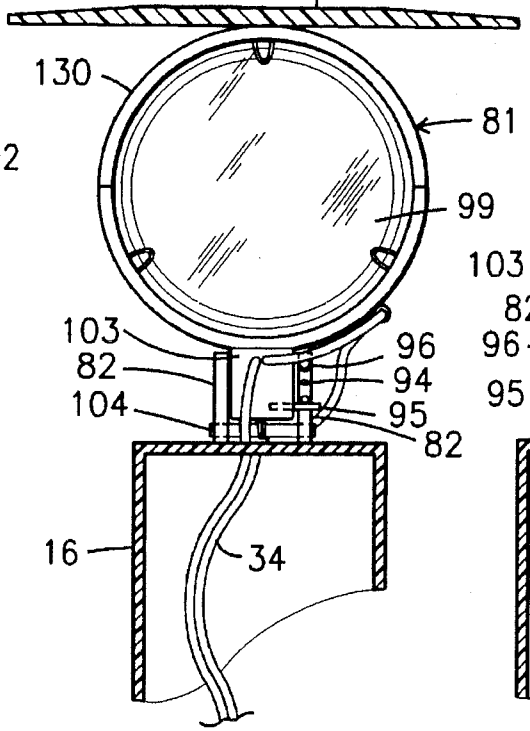
FIG. 27 is a front elevational, sectional view of the FIG. 26 embodiment.
Figure 26:
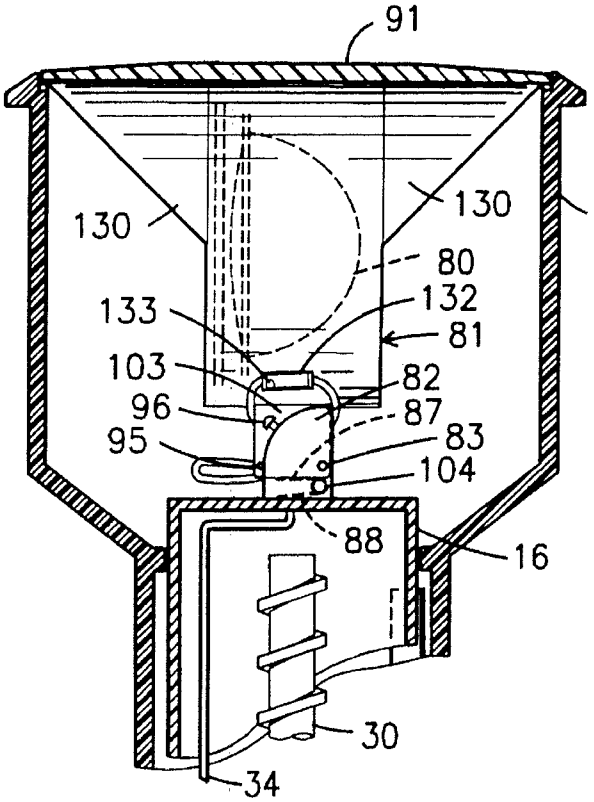
FIG. 26 is a side elevational, sectional view of an embodiment having a hood for the lamp.

Still another embodiment is depicted in FIGS. 26–28. In this embodiment, stiff rod 90 is replaced by a hood or bill 130 which is shaped much like the bill of a baseball cap, as may be gleaned from said figures. Bill 130 serves two purposes. First, it shields the source of the light from the eyes of a person near the novel lamp. Secondly, it performs the function of the aforementioned stiff rod 90, i.e., the edge of bill 130 slides along enclosure 92 as the lamp is deployed into a predetermined angular orientation as described earlier in connection with FIG. 13.

This embodiment also includes mercury switch 132 which is positioned in an electrical circuit between the lamp and a power source. Note in FIG. 26 that a globule of mercury 133 is positioned on a first end of switch 132 when the lamp is fully retracted as depicted in FIG. 26. However, as shown in FIG. 28, said globule 133 slides to the opposite end of switch 132 when the lamp is deployed in a tilted manner. Thus, when the lamp is retracted as in FIGS. 26 and 27, the lamp will be turned off. When it is deployed as depicted in FIG. 28, the lamp will be turned on. This ensures that the lamp will not be turned on when it is retracted.

This embodiment also provides another means for selecting the degree of angular tilt of the lamp. As in the earlier embodiment, the position of pin 96 determines the final angular orientation of the lamp. A spring having legs 87, 88 is positioned around pivot pin 104 to urge flange 103 and hence the lamp in a clockwise direction as depicted in said FIGS. 26–28. A stopping pin or detent 95 is mounted in flange 103 and therefore rotates conjointly therewith. As can be understood from FIGS. 26–28, rotation of the lamp stops when pin 95 abuts pin 96. Note further that a plurality of apertures, collectively denoted 94, for selectively receiving pin 96 is formed in the edge of a preselected frame 82. It should also be observed that flange 103 is pivotally mounted to frames 82 at pivot point 83. Accordingly, diversions of legs 87, 88 of the spring causes flange 103 to pivot about point 83 as best understood by comparing FIGS. 26 and 28.

Figure 29:
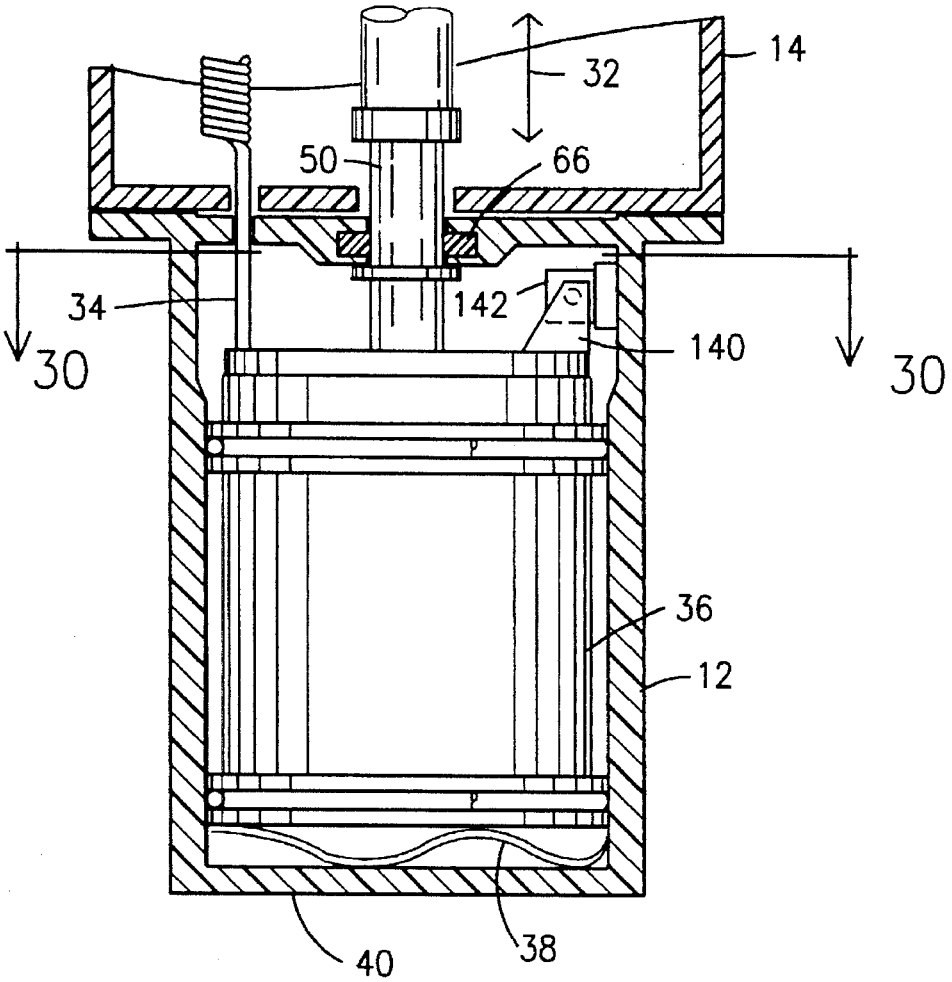
FIG. 29 is a side elevational, sectional view of an embodiment having limit switches activated by rotation of the motor.
Figure 30:
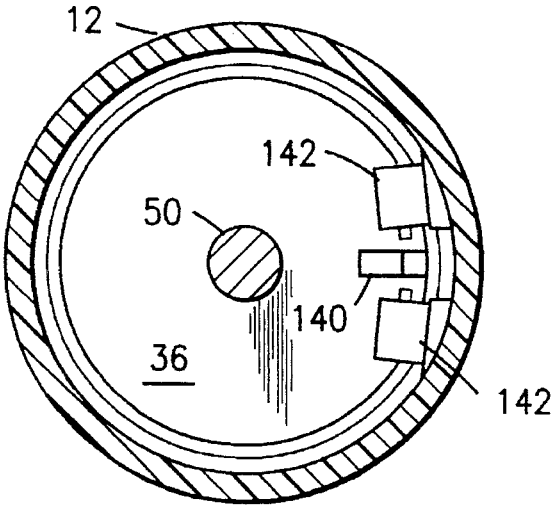
FIG. 30 is a sectional view taken along line 30—30 in FIG. 29.
Figure 31:
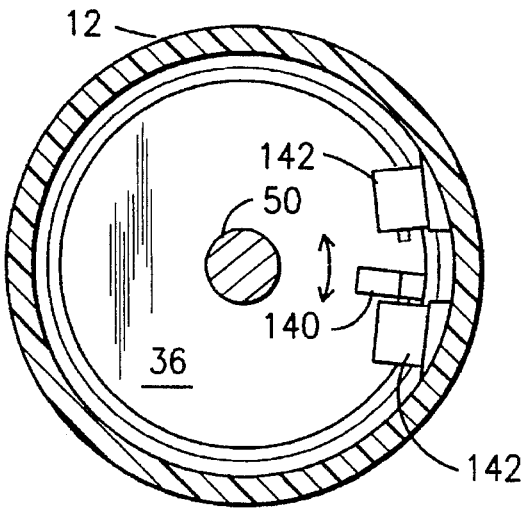
FIG. 31 is a view similar to FIG. 30.

As mentioned earlier, mounting motor 36 so that it may rotate itself relative to its own output shaft when the output shaft is prevented from rotation is an important teaching of this invention. Thus, it follows that the plates and associated electronics of FIGS. 4–7 merely represent one way of harnessing the motor's torque to switch off said motor upon completion of retraction or extension of the telescoping housing. Another way of putting the torque to use for that purpose is disclosed in the embodiment of FIGS. 29–31. Note in those figures that the plates and associated electronics of FIGS. 4–7 are not employed. Instead, a radially extending arm 140 is fixedly secured to the top of motor 36. It is flanked by a pair of circumferentially spaced apart limit switches 142, 144 which are fixedly secured to nonrotatable motor housing 12. FIG. 30 shows fixed arm 140 positioned midway between said limit switches. In FIG. 31, motor 36 has rotated in a clockwise direction relative to its FIG. 30 position because the telescoping housing has been either fully extended or retracted, and the torque generated at the motor's output shaft has been transferred to the motor itself. Accordingly, arm 140 has contacted the switch actuator of limit switch 144. Rotation of the motor in the opposite direction will therefore cause arm 140 to activate the switch actuator of switch 142. Thus, retraction and extension of the telescoping housing, as well as activation and deactivation of the lamp, may be controlled by the simple expedient of positioning limit switches on opposite sides of an arm such as arm 140. This simple design harnesses the torque of the motor to control the operation of the novel pop-up light in a manner that is perhaps easier to understand than the embodiment of FIGS. 4–7.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mounting means for a retractable light, comprising:

an elongate main housing;

an elongate telescoping housing telescopically mounted within said main housing;

means for extending and retracting said telescoping housing with respect to said main housing;

a lamp enclosure formed at an upper end of said main housing;

a pivotally mounted lamp connected to said telescoping housing;

said lamp being fully disposed within said lamp enclosure when said telescoping housing is fully retracted with respect to said main housing;

bias means associated with a lamp housing for urging said lamp to pivot;

retainer means associated with a closure means and said lamp housing for preventing pivoting of said lamp when said lamp is fully disposed within said lamp enclosure;

said retainer means permitting pivoting of said lamp when said lamp emerges from said enclosure upon extension of said telescoping housing from said main housing; and stop means associated with said lamp housing for controlling the amount of pivoting of said lamp after it emerges from said lamp enclosure.

2. The mounting means of claim 1, further comprising:

a closure means overlying said lamp and covering said lamp enclosure when said lamp is fully retracted; and said lamp is positioned within said lamp housing.

3. The mounting means of claim 2, wherein said retainer means is a stiff rod means that extends between said closure means and said lamp housing.

* * * * *